US005515806A

United States Patent [19]

McCabe

[11] Patent Number: 5,515,806

[45] Date of Patent: May 14, 1996

[54] RETRIEVER LADDER

[76] Inventor: Ambrose R. McCabe, R.R. 1 Box 448, Madison Lake, Minn. 56063

[21] Appl. No.: 317,172

[22] Filed: Oct. 3, 1994

[51] Int. Cl.[6] ..... B63B 17/00

[52] U.S. Cl. ..... 114/362; 182/90; 182/92

[58] Field of Search ..... 114/362; 182/90, 182/91, 92, 127, 228

[56] References Cited

U.S. PATENT DOCUMENTS 2,645,504 7/1953 Branstrator et al. ..... 182/91
3,195,680 7/1965 Thornburg et al. ..... 114/362
3,825,097 7/1974 Owen ..... 182/91
3,891,053 6/1975 Burton ..... 114/362

*Primary Examiner*—Sherman Basinger
*Attorney, Agent, or Firm*—Fredrikson & Byron

[57] ABSTRACT

A boat entry system for dogs that clamps on to any boat transom, and still allows room for a motor to be present. The transom clamp is adjustable to allow for different boat transom heights and designs. The platform is angled to allow the dog to swim onto it and has an arm with a pivot point to allow it to be stowed up into the boat when not in use. The arm is offset to one side to permit its use with a motor on the transom.

1 Claim, 4 Drawing Sheets

RETRIEVER LADDER

BACKGROUND OF THE INVENTION

The present invention relates to a dog entry system for eliminating the need of a hunter or boater to lift his/her dog into the boat, risking capsizing of the boat, back injury, or injury to the dog.

A different product on the market is called an "Adjustable Dog Doc" which is a welded one inch square tube framework, wooden platform, adjustable to the water line (non-submersible) with indoor/outdoor carpet on a 24 inch square wooden platform.

The "Retriever Ladder" is different in the following aspects:

1. Offset transom mounting arm which enables its use with a motor.
2. Metal Mesh platform allowing maximum traction for the dog.
3. Metal Mesh platform allowing it to be submersed at an angle below the water line so the dog can swim onto it and easily step into the boat.
4. Pivots out of the water and into the boat for easy stowage.
5. Adjustable transom clamp to allow for different transom heights and designs.

SUMMARY OF THE INVENTION

It is accordingly a primary object of the present invention to provide an easy boat entry system for dogs using only a small portion of the transom, thereby allowing concurrent use of a motor.

It is a further object of the invention to provide an adjustable transom clamp allowing for different boat transom heights and designs.

It is a further object of the invention to have a platform made of metal mesh of good tractability to allow submersion at an angle most conducive for a dog to swim onto allowing easy boat entry.

It is a further object of the invention to have an attachment arm with a pivot point to allow it to be stored up into the boat when not in use.

It is a further object of the invention to have the pivot point of the platform arm offset, taking up minimal transom space to allow room for the motor.

It is a further object of the invention to be easily removed or installed, lightweight, and portable.

Still other objects, advantages and distinctions of the invention will become more apparent upon reference to the following detailed description with respect to the appended drawings. The description is intended to be illustrative only of presently considered constructions and various improvements and modifications thereto. The description should not be strictly construed, but rather should be interpreted within the scope of the following appended claims.

DESCRIPTION OF THE PREFERRED EMBODIMENTS

Figure 1:
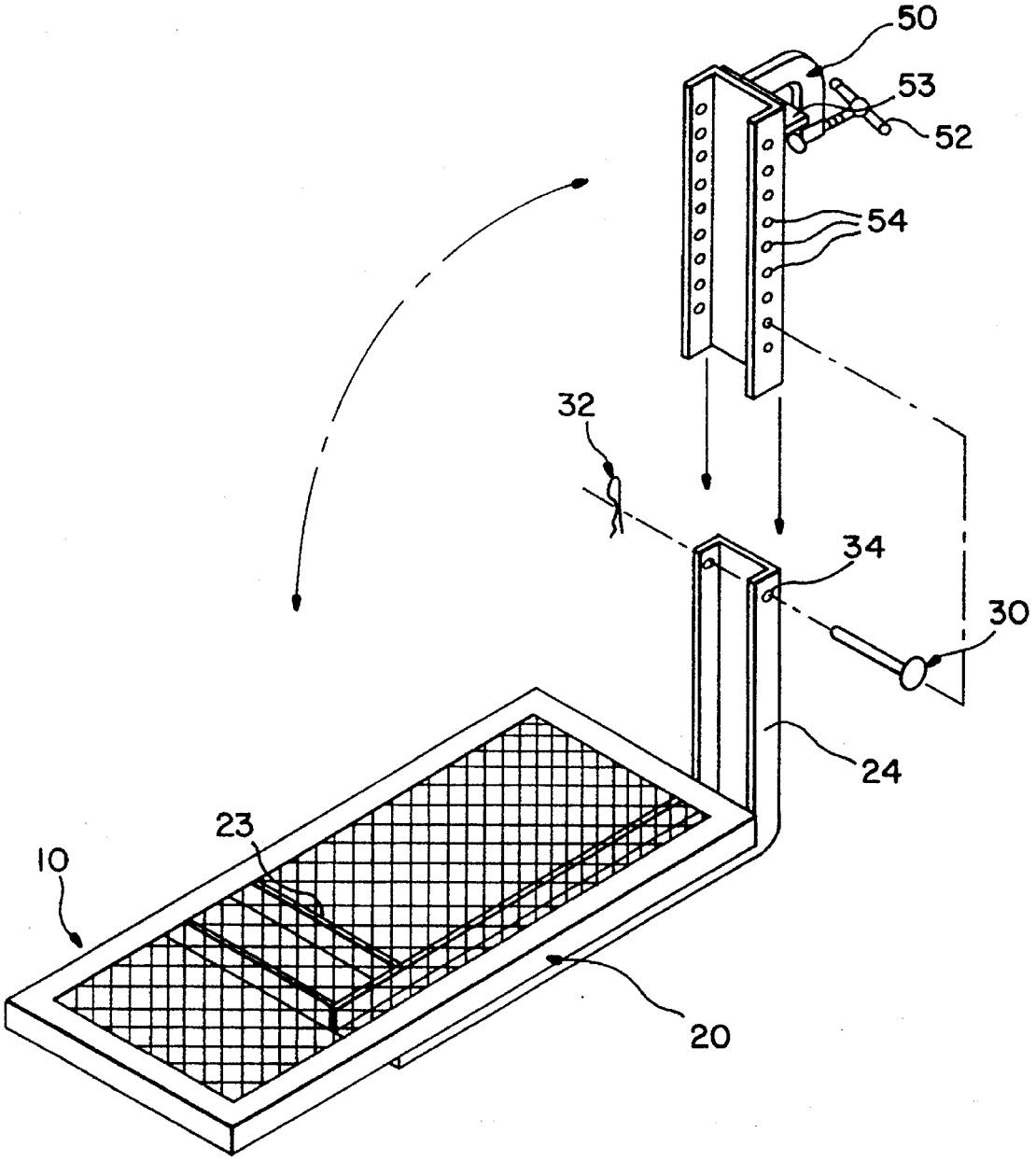
FIG. 1 is a perspective drawing of the individual parts comprising the invention.

Referring to FIG. 1, a perspective drawing is shown of the parts comprising the invention. 10 depicts the platform with the platform arm, 20 depicts the transom mount, 30 depicts the connecting pin on the transom arm, 32 depicts the connecting pin holder, 31 depicts the pivot hole.

Figure 2A:
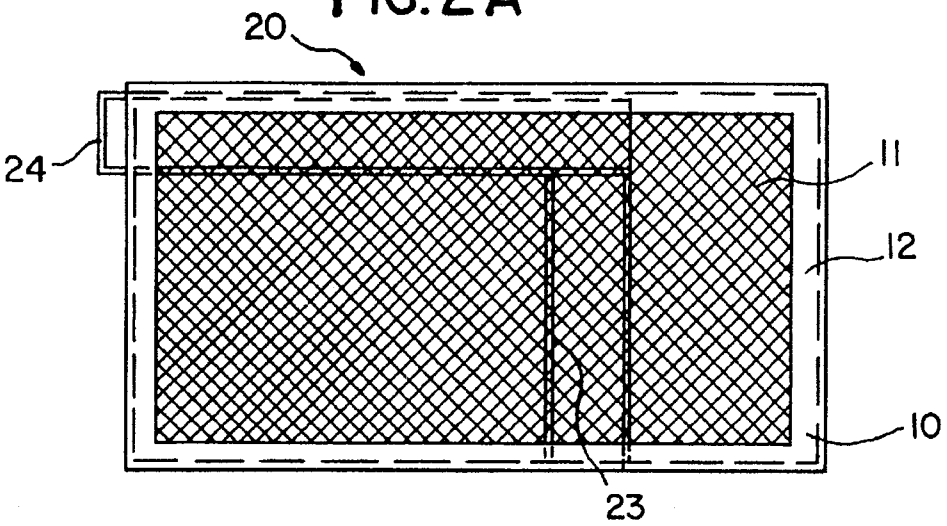
FIG. 2*a* is a detailed perspective drawing of the top view of the platform and platform arm.

Referring to FIG. 2*a*, a top view of the platform 10 and the platform arm 20 is depicted. The metal mesh platform 11, bracing 12 extending along the platform borders and center bracing 23 is also shown in FIG. 2*a*.

Figure 2B:
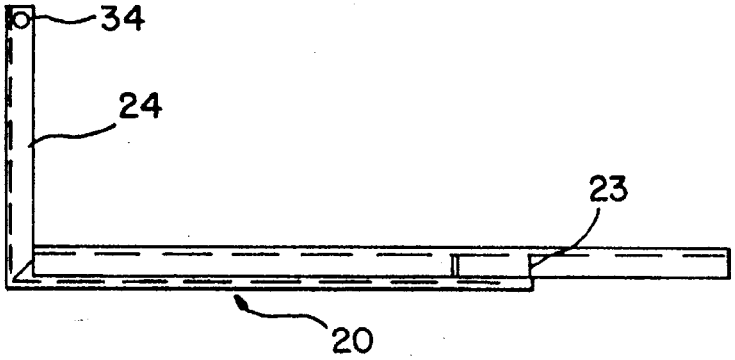
FIG. 2*b* is a detailed perspective drawing of the side view of the platform and platform arm.

FIG. 2*b* shows a side view of the platform 10 and platform arm 20 showing the center bracing 23. The pivot hole 34 is depicted on platform arm 24.

Figure 2C:
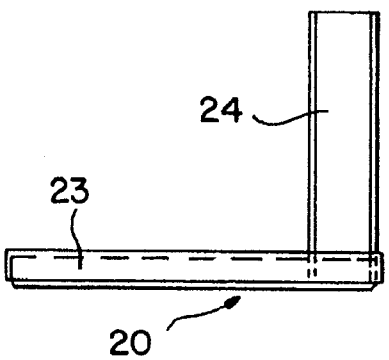
FIG. 2*c* is an end view of the platform and platform arm.

FIG. 2*c* depicts an end view of the platform 10 and platform arm 24 showing border bracing 12, platform center bracing 23, and placement of pivot hole 34.

Figure 3A:
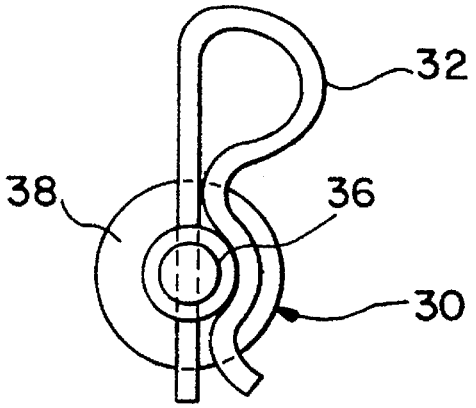
FIG. 3*a* is an end isolation view of the adjustable connecting pin and manufactured connecting pin holder that secures the transom mount to the platform arm.

FIG. 3*a* depicts a side view of the manufactured connecting pin holder 32 and the end view of connecting pin 30.

Figure 3B:
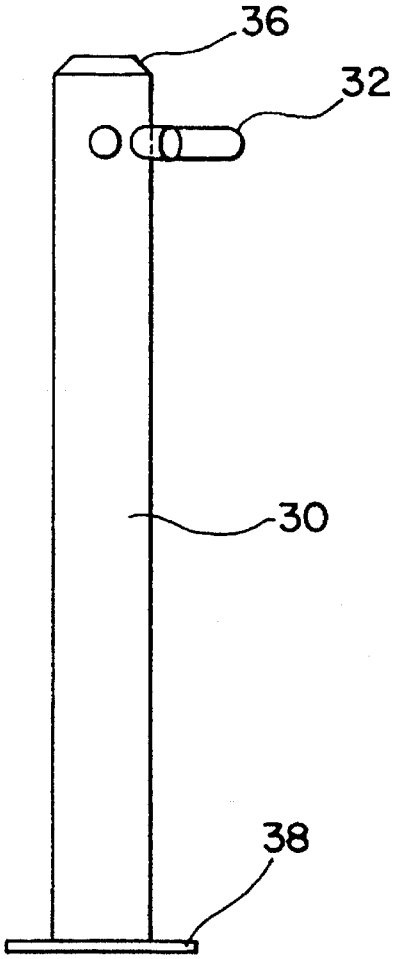
FIG. 3*b* is a side view of the connecting pin, chamfer, and connecting pin stop.

FIG. 3*b* depicts a side view of the connecting pin 30, a top view of manufactured connecting pin holder 32, an angled chamfer 36, and a connecting pin stop 38.

Figure 4A:
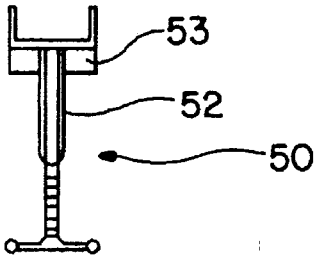
FIG. 4*a* is a top view of the transom mounting apparatus.

FIG. 4*a* depicts a top view of the transom mount arm 50, transom mount clamp 52, transom mount stop 53 and transom height adjustment holes 54.

Figure 4B:
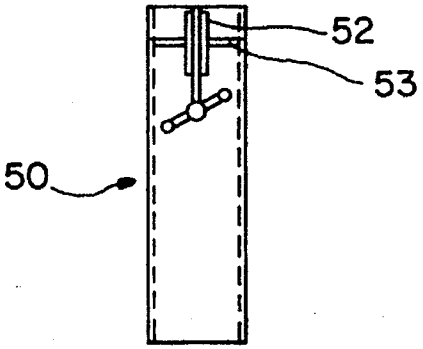
FIG. 4*b* is a front view of the transom mount arm.

FIG. 4*b* depicts a front view of the transom mount arm 50, transom mount clamp 52, transom mount stop 53 and transom height adjustment holes 54.

Figure 4C:
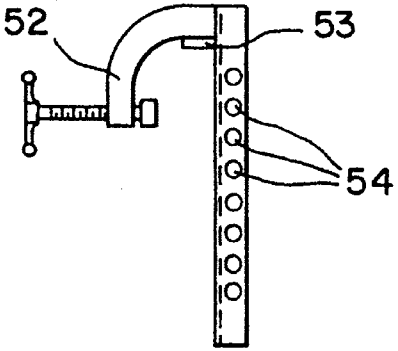
FIG. 4*c* is a side view of the transom mount arm.

FIG. 4*c* shows a side view of the transom mount arm 50, transom clamp 52, transom mount stop 53, transom height adjustment holes 54.

Platform arm 20 (FIG. 2*b*) and transom arm 50 (FIG. 4*b*) are connected by connecting pin 30 (FIG. 3*b*) and held by manufactured connecting pin holder 32 (FIG. 3*a*).

Transom mount 50 (FIG. 4*c*) is clamped to the transom of the boat using transom arm clamp 52 (FIG. 4*c*).

While the invention has been described with respect to various presently considered constructions, improvements and modifications thereto, it is to be appreciated that still other configurations might suggest themselves to those skilled in the art. Accordingly, it is contemplated that the following appended claims should be interpreted to include all those equivalent embodiments within the spirit and scope thereof.

I claim:

1. A ladder attachable to a boat for enabling the easy return from the water to the boat of a dog, the ladder comprising;

a transom mount arm, said transom mount arm including a plurality of height adjustment pivot holes disposed along the length thereof;

a platform arm, said platform arm including a vertically extending section having an upper end and a lower end, said vertically extending section having a pivot hole at the upper end thereof, said platform arm further including a horizontally extending section fixedly attached at the lower end of said vertically extending section, said platform arm also including a horizontally extending center bracing, said center bracing fixedly attached to an end of said horizontally extending section spaced from said vertically extending section and having a longitudinal axis perpendicular to a longitudinal axis of said horizontally extending section;

a metal mesh platform, said metal mesh platform having bracing along the borders thereof, said metal mesh platform being rectangular in shape and having a first side extending along a length thereof, said metal mesh platform being fixedly attached along said first side to said horizontally extending section of said platform arm such that said center bracing extends laterally across a mid portion thereof;

a connecting pin, said connecting pin releasably connecting the upper end of said vertically extending section and said transom mount arm by passing through both said hole at the upper end of said vertically extending section and one of said plurality of height adjustment holes of said transom mount arm, said connecting pin allowing said platform arm and said metal mesh platform to be pivoted with respect to said transom mount arm;

and a transom mounting clamp, said transom mounting clamp being attached to the transom mount arm at an upper end thereof for releasably attaching said ladder to the transom of a boat.

* * * * *